United States Patent [19]

Hayes

[11] 4,452,135

[45] Jun. 5, 1984

[54] FIRE HOSE RETRACTING AND FLATTENING APPARATUS

[76] Inventor: Robert H. Hayes, 19A Forest Glen Rd., Valley Cottage, N.Y. 10989

[21] Appl. No.: 298,151

[22] Filed: Aug. 31, 1981

[51] Int. Cl.[3] ..... B30B 3/00

[52] U.S. Cl. ..... 100/153; 100/100; 100/118; 100/121; 100/171; 100/172; 100/173; 68/257; 137/355.2; 226/187; 239/197

[58] Field of Search ..... 100/100, 153, 155, 121, 100/171, 173, 172, 176, 118; 239/197; 68/244, 257, 265; 226/108, 187; 137/355.12, 355.2, 355.28

[56] References Cited

U.S. PATENT DOCUMENTS

| | | | |
|---|---|---|---|
| 965,486 | 7/1910 | Putt | 100/153 X |
| 1,911,682 | 5/1933 | Gardiner et al. | 100/153 |
| 2,376,494 | 5/1945 | Larabee | 100/153 |
| 3,601,038 | 8/1971 | Hayes | 100/100 |
| 3,866,532 | 2/1975 | Ogden | 100/171 |

*Primary Examiner*—Billy J. Wilhite

*Attorney, Agent, or Firm*—McAulay, Fields, Fisher, Goldstein & Nissen

[57] ABSTRACT

A fire hose retracting and flattening apparatus has a first endless belt having a width at least as great as that of the hose to be retracted which is mounted in a main frame so as to have a generally planar run thereof on which the hose can be lain. The belt is mounted so as to be operatively connected to a motor to effect the driving thereof in a retracting direction. First and second pairs of rollers are provided which co-act with the planar run of the belt to retract and flatten the hose disposed thereon. The first and second roller pairs are mounted above the planar run, with the first roller pair downstream of the second roller pair, for pivotal movement between a first position wherein the first roller pair is adjacent to the run and the second roller pair is spaced apart therefrom and a second position wherein the first roller pair is spaced apart from the run and the second roller means is adjacent thereto. In addition, a spring biases the first roller pair towards the run in the first position and the second roller pair towards the run in the second position and effects movement of the first and second roller pairs from the first position to the second position in response to a predetermined separation between the first roller pair and the belt.

10 Claims, 3 Drawing Figures

FIRE HOSE RETRACTING AND FLATTENING APPARATUS

BACKGROUND OF THE INVENTION

The present invention relates to an automatic apparatus for retracting and flattening a fire hose.

In the field of fire fighting, it is well known that one of the most difficult tasks after the fire has been extinguished is to retract a long fire hose and put it back in the fire engine in a folded condition. The difficulties in carrying out this task relate to the length of the hose, the weight of the hose and the water and air that is remaining in the hose which adds to its weight and bulk.

Thus, in order to fold and arrange the hose in the fire engine, it is necessary for the firemen to squeeze the air and water out of the hose manually to get it into a flat condition and thereafter pull the hose onto the truck while folding same.

The manual operation of folding a 1500 foot fire hose generally involves six men and approximately 45 minutes of time.

An automatic fire hose retraction apparatus has been disclosed in U.S. Pat. No. 3,601,038 wherein the fire hose is flattened and retracted by two spring biased rollers through which the hose is pulled.

A disadvantage of this prior art system is the difficulty it has with hose couplings. Because the hose couplings must be pulled through these rollers a great deal of force is necessary on the one hand, and on the other hand, during the separation of the squeezing rollers air and water is permitted to be forced through the hose thus filling the portion already squeezed.

SUMMARY OF THE INVENTION

The main object of the present invention is to provide a fire hose retracting and flattening apparatus which eliminates the disadvantages of the prior art and which enables a fire hose to be retracted and flattened and easily manipulated when a hose coupling is encountered.

These and other objects and advantages of the present invention are achieved in accordance with the invention comprising a first endless belt having a width at least as great as that of the hose to be retracted which is mounted in a main frame so as to have a generally planar run thereof on which the hose can be lain. The belt is mounted so as to be operatively connected to a motor to effect the driving thereof and appropriately determine the retracting direction. First and second roller means are provided which co-act with the planar run of the belt to retract and flatten the hose disposed thereon. The first and second roller means are mounted above the planar run, with the first roller means downstream of the second roller means, for pivotal movement between a first position wherein the first roller means is adjacent to the run and the second roller means is spaced apart therefrom and a second position wherein the first roller means is spaced apart from the run and the second roller means is adjacent thereto. In addition, biasing means biases the first roller means towards the run in the first position and the second roller means towards the run in the second position and effects movement of the first and second roller means from the first position to the second position in response to a predetermined separation between the first roller means and the belt.

As a result of this structure, if the roller means are in their first position, the hose disposed on the run and between the first roller means and the belt is continuously retracted and squeezed due to the driving by the motor. When a coupling is encountered, it will pass the position of the second roller means disposed upstream of the first roller means and will reach the first roller means which is adjacent to the run. At this point, the separation caused by the coupling will flip the means mounting the roller means into the second position so that the second roller means is now adjacent to the run with the hose therebetween on the other side of the coupling. Thus, this squeezing action will prevent water disposed upstream of the coupling from being forced into the already flattened hose. Once the coupling passes the first roller means, the means mounting the roller means can be flipped back into the first position and operated in this manner until the next coupling is reached.

The first roller means comprises two parallel rollers which are rotationally coupled to each other and which are only driven when in the first position. In this manner, the drive system of the apparatus can be constructed so that if for some reason the apparatus should malfunction and does flip when the coupling is reached, the belt will merely slip on the rollers and not cause any permanent damage to the apparatus or to the hose. Moreover, the motor can be constructed so that an increased load thereon would cause the motor to automatically kick out.

Another feature of the invention is that the radial centrifugal force on the belt is increased at a certain point in its travel so as to throw off debris picked up on the hose.

The present invention gives the advantages of enabling to handle 1500 feet of hose in only 18 minutes utilizing only two men as opposed the aforementioned 45 minutes for six men according to the manual method.

Other advantages of the present invention will be understood from the detailed description thereof with reference to the accompanying drawings wherein;

DETAILED DESCRIPTION OF THE INVENTION

Figure 1:
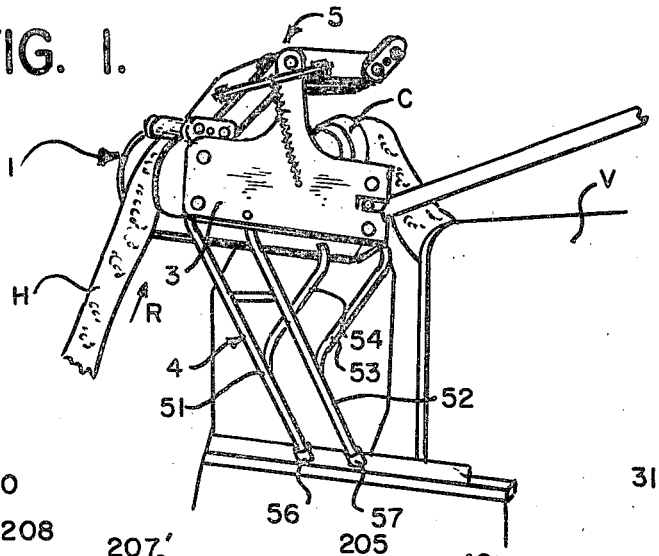
FIG. 1 is a perspective view of the hose retraction apparatus according to the present invention as shown installed on fire vehicle.
Figure 2:
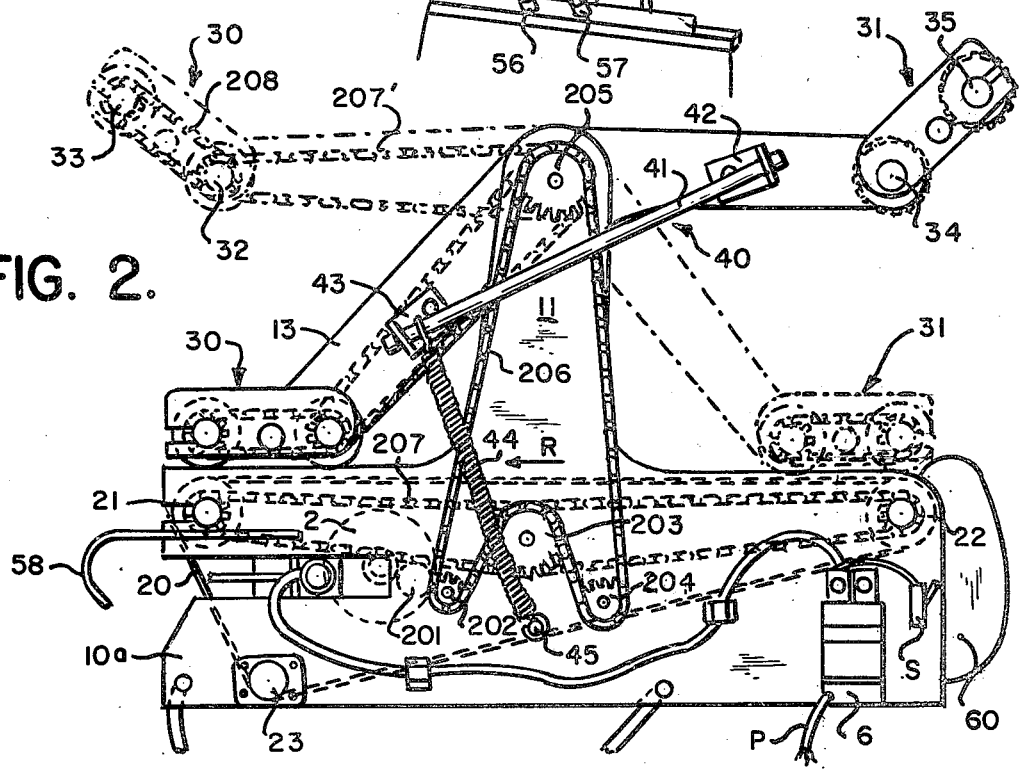
FIG. 2 is a side view of the apparatus according to the present invention.
Figure 3:
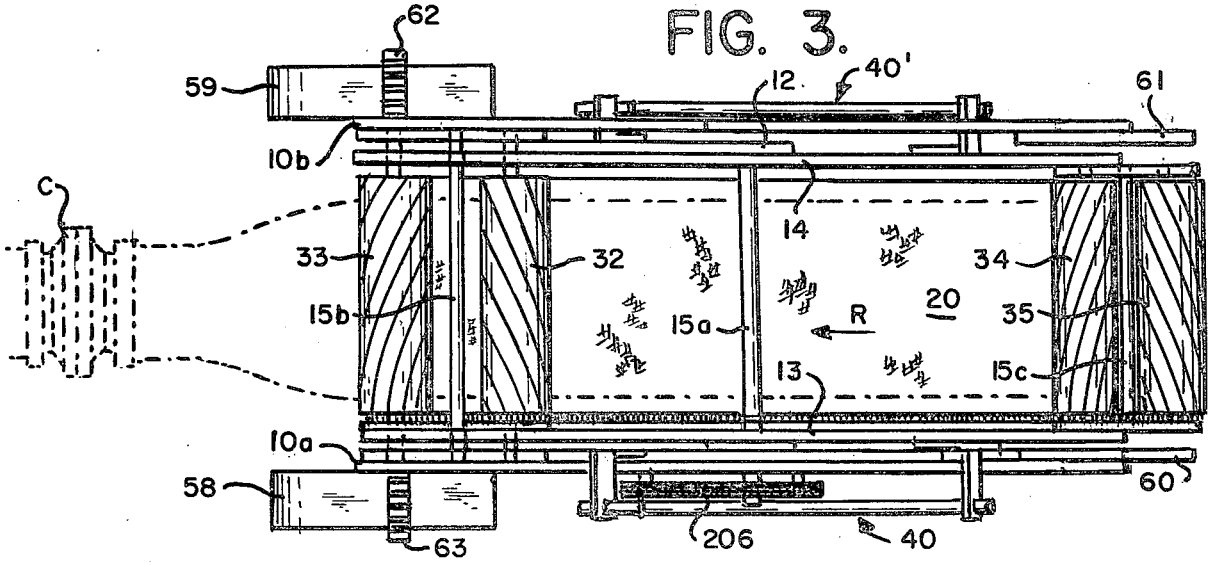
FIG. 3 is a top view of the apparatus of FIG. 2.

Referring now to FIGS. 1–3, the apparatus 1 is shown in use in FIG. 1 attached to the rear end of a vehicle V. The apparatus 1 receives the hose H for retracting it in a direction R and is adaptable to pass a coupling C therethrough without any difficulty. The apparatus includes the main frame 3 to which pivotally mounted roller means 5 for effecting a retracting and flattening of the hose H and mounting means 4 for stabilizing the apparatus at the back of a fire engine V.

The main frame 3 includes two side walls 10*a*, 10*b* between which an endless belt 20 is mounted for movement in a direction R around rollers 21, 22 and 23. The roller 21 and 22 define a generally planar run on which the hose is lain during use as will be explained hereinafter.

The side walls 10*a* and 10*b* also include upwardly projecting arms 11,12 for pivotally mounting roller means 30 and 31 over the endless belt 20.

The roller means 30, 31 are mounted on a frame formed by arms 13, 14 which are connected together by cross rods 15*b*–*c* and which pivot about 15*a* which is disposed intermediate of the two arms 13, 14.

The roller means 30 comprises two parallel rollers 32, 33 and the roller means 31 comprises two parallel rollers 34, 35. The rollers 32–35 are parallel to rollers 21, 22 and when the arms 13, 14 are pivoted in the first position shown by the solid lines of FIG. 2, the roller 33, is aligned directly above roller 21 to effect the squeezing and retracting action of a hose therebetween. When the arms 13, 14 are in the second position shown in dotted lines in FIG. 2, the roller 35 is aligned above the roller 22 to effect the squeezing and flattening action on the hose.

The drive system for the rollers as shown in FIGS. 1–3 is as follows. The apparatus is provided with an electric motor 2 which receives its power from power cord P which can be plugged into an auxiliary source that may be located on the fire vehicle. The power cord feeds the power supply 6 which has an on/off switch S connected in series therewith. The power supply feeds the motor 2 which is thereafter mechanically coupled to the drive system as follows. The motor is geared via gear 201 to gear 202. Gear 202 has a corotational sprocket for receiving chain 206 and chain 206 extends around sprocket 205 which is connected to rod 15*a*, sprocket 204 and sprocket 203. Sprocket 203, is connect to a shaft having corotational sprockets thereon which are connected via chains 207 and 208 to rollers 21 and 22 respectively. In this manner, the actuating of the motor 2 effects the driving of the endless belt in the direction R. Sprocket 205 has a corotational sprocket which drives chain 207 which in turn is connected to a sprocket wheel on roller 32 which is coupled to roller 33 via chain 208.

Rollers 34 and 35 are driven only when in the position shown in dotted lines in FIG. 2 by means of engagement of the rollers with the moving belt 20

In this manner, the movement of belt 20 causes rollers 34 and 35 to rotate when in the position shown by dotted lines in FIG. 2. To be more specific, when the arm of the apparatus is in the dotted line position of FIG. 2, the hose is sandwiched between the movable belt 20 and the rollers 34 and 35. Accordingly, the movable belt will cause the hose to move in the direction indicated by the arrowhead R in FIG. 2. Since the hose is in contact with the rollers 34 and 35 for the dotted line position of the arm, these rollers will similarly rotate about their respective axes. However, since these rollers are in contact with the hose for a relatively short time (i.e., only during the time it is necessary to permit a coupling to pass beyond the other set of rollers 32, 33) there is no need to drive these rollers by a separate independent chain as there is with respect to rollers 32, 33.

In operation, the apparatus 1 is mounted on the rear of a vehicle V which has a connecting bar thereon, by means of the hooks 58, 59 and the collaspible support 4. The support can be folded from the position shown in FIG. 1 to a relatively flat position, however, when in the position shown in FIG. 1, includes the mounting legs 51, 52 and support legs 53, 54 with rubber feet 56 and 57 extending at the termini of legs 51 and 52 to support the apparatus 1 in the position shown.

Although pivotally mounted about rod 15*a* as shown the roller means 30 and 31 must be biased towards the endless belt 20 to obtain the necessary force to retract the hose and squeeze same to flatten it. Additionally, when a coupling C is encountered in the apparatus, it is desired to flip the roller support arms 13, 14 from the position shown in the solid lines to the position shown in the dotted lines. This is accomplished by means of the toggle mechanisms 40, 40′ disposed on either side of the apparatus. For the sake of clarity, only the toggle mechanism 40 is explained in detail.

The toggle mechanism is an over the center toggle and comprises a rod 41 connected to arm 13 at either side of the pivot connection by clamps 42 and 43. A spring 44 has one end thereof slidably connected on the rod 41 while the other end is connected at point 45 to frame wall 10*a* for pivotal movement. The point of connection at 45 is just aligned with the pivot point for arm 13 so as to achieve the toggling effect as will be described hereinafter.

In operation, the apparatus is mounted on a truck shown in FIG. 1, however with the arms 13 and 14 in the so called first position shown in solid lines in FIG. 2. In this position, the rollers 32 and 33 coact with the belt 20 to retract the hose H to the left. In this condition the toggle mechanism 40 is in the position shown.

When a coupling C reaches the apparatus, it will slowly make its way toward the roller 32. As the apparatus pulls the coupling therethrough it will tend to separate rollers 32 and 33 from the belt 20, thereby pushing the rollers 32 and 33 in the upward direction. This movement effects a sliding movement of the slidable end of the spring 44 along rod 41. When the spring 44 passes the center of the rod 41 to the sliding motion, the toggle mechanism will toggle forcing the arms 13, 14 to shift into the second position shown by the dotted lines in FIG. 2. Since the coupling is downstream of rollers 34, 35, the retracting and flattening operations will continue while the coupling is easily passed through the apparatus. This condition is shown in FIG. 1.

When the coupling is safely received on the bed of the vehicle, handles 62 and 63 can be used to flip the arms 13, 14 back to the position in FIG. 2 in solid lines to continue the operation until the next coupling is encountered.

If the arms 13, 14 do not flip at the desired time, the coupling will not destroy the apparatus nor will the apparatus destroy the coupling due to various safety features which are inherent in the system. Firstly, the belt 20 will slip on rollers 21–23 if the coupling becomes stuck between roller 32 and belt 20. Moreover, the motor power supply can be conventionally constructed to automatically turn off when the load on the motor exceeds a predetermined level which is indicative of the fact that the coupling is stuck in the apparatus. Moreover, other modifications can be made to improve the effectness of the apparatus. For example, rollers 21 and 22 may be of two inch diameter whereas roller 23 is one-half inch. In this way, as the belt goes around the shaft 23 debris on the belt will be flung off.

The rollers are preferably made of a strong plastic material such as Lexan while the frame and support members made of rigid metal such as steel and aluminum. In an actual embodiment, the main drive sprocket 201 was provided with 48 teeth and all other sprockets contain 20 teeth. However, the main drive sprocket can vary in size in accordance with the desired speed of operation.

While a perferred embodiment has been shown and described, it is obvious that numerous omissions, changes and additions may be made in such embodiment without departing from the spirit and scope of the present invention.

What is claimed is:

1. A fire hose retracting and flattening apparatus comrpising:

a main frame;

an electric motor mounted in the main frame;

a first endless belt having a width at least as great as that of the hose to be retracted;

means mounting the first belt in the main frame to dispose a generally planar run thereof on which a hose can be lain, the mounting means including means operatively connecting the first belt to the motor to effect the driving thereof in a predetermined retracting direction;

first and second roller means for coacting with the planar run of the belt to retract and flatten a hose disposed therebetween;

means mounting the first and second roller means above the planar run, with the first roller means downstream of the second roller means, for pivotal movement between a first position wherein the first roller means is adjacent said run and the second roller means is spaced apart therefrom and a second position wherein the first roller means is spaced apart from the run and the second roller means is adjacent thereto; and means biasing the first roller means towards the run in the first position and the second roller means towards the run in the second position and effecting movement of the first and second roller means from the first position to the second position in response to a predetermined separation between the first roller means and the belt run.

2. The apparatus according to claim 1, further comprising means operatively connecting the first roller means to the motor in both the first and second positions.

3. The apparatus according to claim 2, wherein the means operatively connecting the motor to the belt and first roller means comprises a chain drive.

4. The apparatus according to claim 1, wherein the first and second roller means each comprise first and second pairs of rotationally coupled parallel rollers, respectively.

5. The apparatus according to claim 4, wherein the means mounting the endless belt comprises at least two spaced belt rollers mounted in the frame parallel to each other and to the first and second pairs of rollers and wherein one roller of the first pair of rollers is aligned with one belt roller in the first position and one roller of the second pair of rollers is aligned with the other belt roller in the second position.

6. The apparatus according to claim 1, wherein the means mounting the first and second roller means comprises a roller frame including two elongated parallel arms pivotally connected to the main frame at the central portion thereof and between which the first and second roller means are mounted at the two termini thereof.

7. The apparatus according to claim 6, wherein the means biasing the roller means comprises an over the center toggle mechanism including a rod connected to one arm at either side of the pivot connection, and a spring slidably connected at one end of the rod and pivotally connected at the other end of the main frame aligned with the pivot connection.

8. The apparatus according to claim 1, further comprising means for releasably connecting the main frame to a vehicle.

9. The apparatus according to claim 8, wherein the releasable connecting means comprises two legs connected to the main frame for resting on the vehicle and two hooks fixed to the main frame and releasably engagable with a vehicle.

10. The apparatus according to claim 6, further comprising handles, disposed on the arms at the ends mounting first roller means, for enabling manual movement of the roller means to the first position from the second position.

* * * * *